United States Patent [19]

Dodge et al.

[11] 3,949,771

[45] Apr. 13, 1976

[54] COMBINED WASHER AND ASPIRATOR

[75] Inventors: John Dennis Dodge, Arlington Heights; Robert Francis Koschalk, Zion, both of Ill.

[73] Assignee: Abbott Laboratories, North Chicago, Ill.

[22] Filed: July 10, 1974

[21] Appl. No.: 487,356

[52] U.S. Cl. ..... 134/94; 134/174; 134/182; 134/195; 134/198

[51] Int. Cl.[2] ..... B08B 3/02; B08B 5/04

[58] Field of Search ..... 134/84, 88–89, 134/103, 94, 136–137, 144, 149, 151, 154, 156, 172, 174, 182–183, 191, 195, 198, 201; 239/124–127

[56] References Cited

UNITED STATES PATENTS

| | | | |
|---|---|---|---|
| 2,342,001 | 2/1944 | Magnuson | 239/126 X |
| 2,519,654 | 8/1950 | Heaney | 134/103 |
| 2,788,008 | 4/1957 | Wanzer | 134/156 X |
| 3,375,834 | 4/1968 | Best et al. | 134/94 |
| 3,399,463 | 9/1968 | Stott | 134/149 X |
| 3,840,181 | 10/1974 | Vier et al. | 239/127 |

*Primary Examiner*—Robert L. Bleutge
*Attorney, Agent, or Firm*—Robert L. Niblack; Neil E. Hamilton

[57] ABSTRACT

A combined washer and aspirator device which is readily adapted to both aspirate and wash material from a solid body in a confined space. The washer-aspirator device is especially constructed to be utilized in conjunction with a hepatitis test wherein the device can remove and/or wash serum from a detection carrier such as a spherical ball. In a preferred embodiment, the device has a probe with an orifice for holding the ball in a suspended state as it is washed and aspirated.

11 Claims, 5 Drawing Figures

COMBINED WASHER AND ASPIRATOR

BACKGROUND OF THE INVENTION

This invention relates to a device which can both wash and aspirate the wash water from a solid body member. More particularly, this invention relates to a combined hand washer and aspirator apparatus which is utilized in conjunction with a hepatitis detection apparatus and procedure.

In the process of conducting laboratory testing for diseases it is often necessary to wash and rinse off detection media with rinsing solutions and subsequently to remove the rinsing solution from a container into which a detection means and the media to be detected, such as a serum, is placed. There is not currently available a device which can conveniently function as both a washing and aspirating apparatus which can be handled in a convenient manner and can effect the washing and removal of the wash solution in a fast and efficient manner without spillage. The type of hepatitis detection procedure in which this apparatus is conveniently utilized is known as Ausria II-125 system which utilizes a solid phase radioimmunoassay technique to measure Hepatitis Associated Antigen (HAA) levels in serum. In this procedure, plastic beads are coated with guinea pig antibody which are supplied in a kit form. Patient serum is added and, during incubation, any antigen from this serum is fixed to the antibody. When antibody tagged with iodine-125 is added, it binds to any antigen on the bead creating an antibody-antigen-antibody "sandwich." This procedure is the subject of an article entitled "Prevalence of Hepatitis B Virus Antigen as Revealed by Direct Radioimmune Assay with 125 I-Antibody" appearing in *The Journal of Immunology*, Vol. 109, No. 4, October 1972, p. 834. When conducting the foregoing test it is necessary to evacuate the serum which is placed in a small well-like container of a tray which also contains the bead. Further, it is necessary that each well and bead be rinsed and that the procedure of rinsing and evacuation be repeated any given number of times.

It is an advantage of the present invention to provide a novel washer and aspirator which is easily manipulated and can efficiently wash and remove the wash solution from a container for a detection device; to provide a combined washer and aspirator device which can simultaneously wash and hold the solid body member out of contact from a container for the solid body; to provide a washer and aspirator device which can fit easily within the confines of a small well and can afford a rinsing technique without spattering or spillage; and to provide a washer and aspirator device which can be utilized in conjunction with readily available sources of vacuum and pumping mechanisms as well as being inexpensively produced.

SUMMARY OF THE INVENTION

The foregoing objects are accomplished and the shortcomings of the prior art are overcome by the present combined washer and aspirator device which comprises a hand-held body member having two independent fluid passages. One of the passages connects to a source of vacuum and the other to a source of fluid under positive pressure such as from a pumping device. From the body section and in fluid communication with the two fluid passages extend nozzle members with probes having a fluid intake channel and a fluid outlet channel as well as an orifice. The fluid intake channel communicates with the fluid passage in the body member connected to the vacuum source and the fluid outlet channel is connected to the fluid passage in the body section which is ultimately connected to the pump. The orifice in the probe has an internal wall surface with positioning means to limit movement of a solid body member and hold the solid body member in a spaced manner from the wall surface of the orifice so as to permit fluids to flow around the solid body member as it is retained by means of the vacuum source in the central fluid intake channel. In a preferred manner, the fluid outlet and inlet channels in the nozzles are formed from two inner and outer concentrically positioned tubular members. When the combined washer and aspirator device is to be utilized in conjunction with the washing and retention of a spherical body member, the orifice is provided with a concave indentation with projections extending from the wall of the probe so as to position a spherical solid body member in a spaced distance from the wall of the orifice. To effect outward flow of fluid from the nozzle, the outer tubular member is spaced a short distance from the end wall of the orifice and the inner tubular member has deflecting surfaces in the probe portion so that the fluid is caused to deflect at approximately a 45° angle from the longitudinal axis of the nozzle. The combined washer and aspirator device preferably has a multiplicity of nozzle members which are designed to fit within small wells of a plastic tray and to be easily manipulated by the human hand.

BRIEF DESCRIPTION OF THE DRAWINGS

A better understanding of the present combined washer and aspirator device will be accomplished by reference to the drawing wherein.

DESCRIPTION OF THE PREFERRED EMBODIMENT

Figure 1:
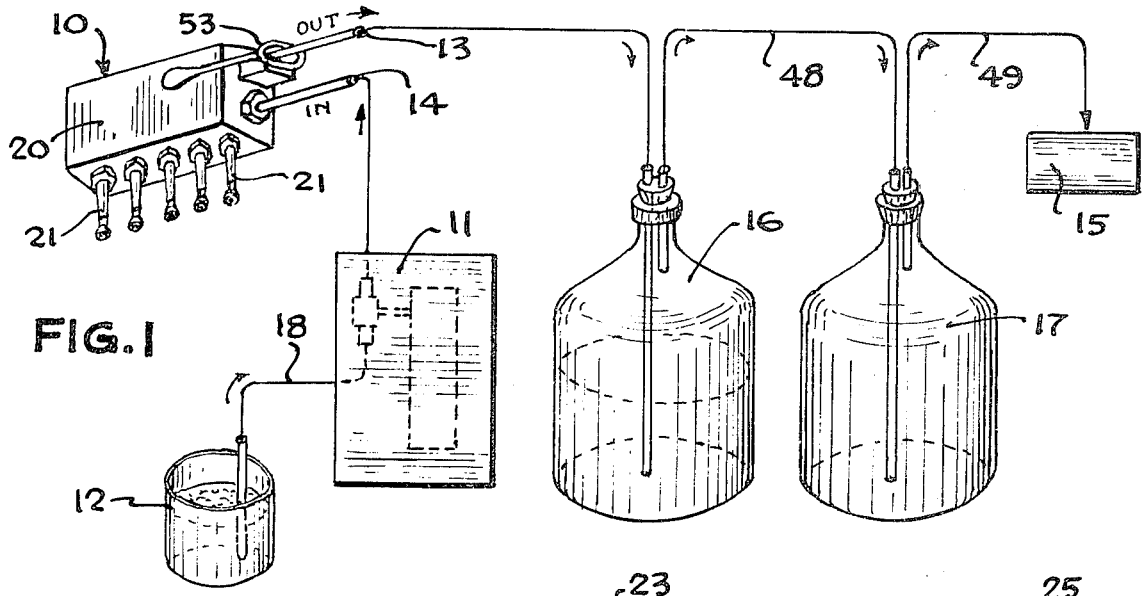
FIG. 1 is a perspective view of the combined washer and aspirator device operatively connected to a fluid source as well as a source of vacuum.

Proceeding to a detailed description of a preferred embodiment of the present invention, the combined washer and aspirator device 10 is operatively connected to a source of fluid 12 by means of a pumping device 11 and intake lines 14 and 18. It is also in fluid communication with a vacuum source 15 which is interconnected through outlet lines 13, 48 and 49 to two vacuum trap bottles 16 and 17.

Figure 2:
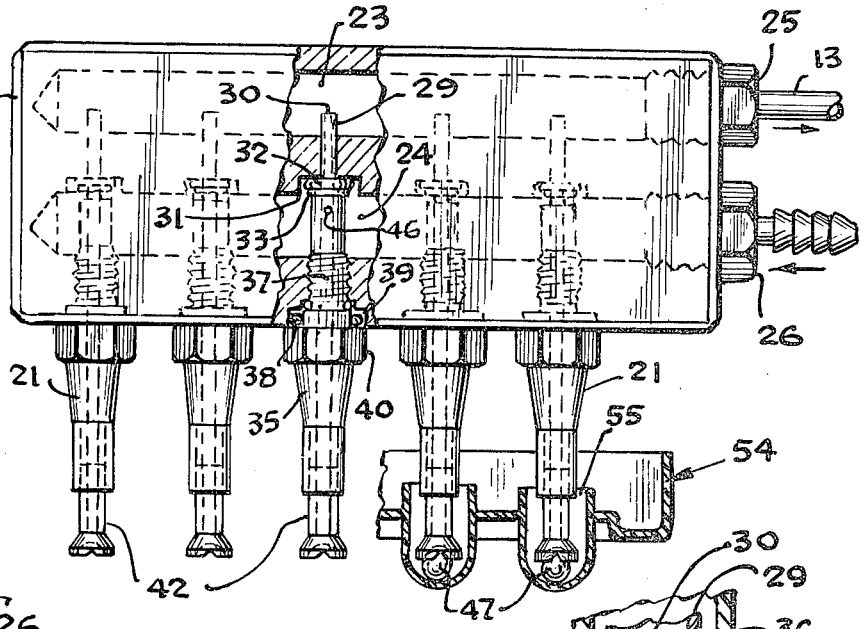
FIG. 2 is an enlarged view of the combined aspirator and pumping device with a portion broken away and with other portions in operative engagement with well members of a tray.
Figure 4:
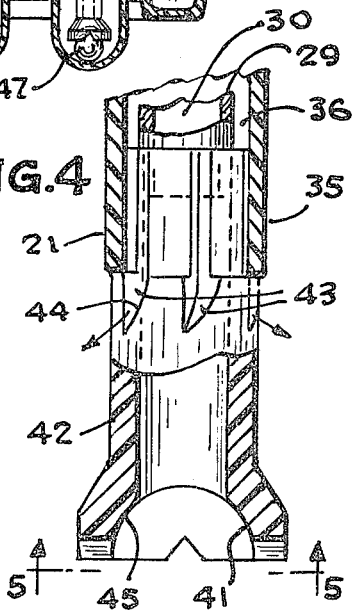
FIG. 4 is an enlarged partial view of one of the nozzle members of the combined washer and aspirator device illustrating the inner and outer concentric tubular members and the passages formed therein.

The combined washer and aspirator is composed of a generally rectangular body section 20 from which extend a multiplicity of nozzle members 21. Referring specifically to FIG. 2, it will be seen that body section 20 has two generally parallel independent fluid passages 23 and 24 which communicate with outlet line 13 and intake line 14, respectively. This is effected through outlet an intake connectors 25 and 26, respectively, which are preferably screw threaded into body section 20 and surround fluid passages 23 and 24. Each nozzle 21 is composed of an inner inlet tube 29 defining an intake channel 30. Inner tube 29 is retained in body section 20 by means of a compartment 31 housing an O-ring 32 which is held in the compartment by means of a retaining ring 33 held on inner tube 29 by means of the usual retaining groove (not shown). Surrounding inner tube 29 in a concentric manner and spaced therefrom is an outer tubular member 35 which, as best shown in FIG. 4, provides a fluid outlet channel 36. Outer tubular member 35 contains threads 37 for engaging body member 20 and is sealed therein by means of an O-ring 38 held in a compartment 39 by means of nut portion 40. It will be noted that outer tubular member 35 terminates in liquid passage 24 and has its upper end portion in open communication therewith. It will also be noted that inner tubular member 29 has a probe portion 42 with an orifice 41 for communicating with intake channel 30 and ultimately with intake passage 23.

Figure 3:
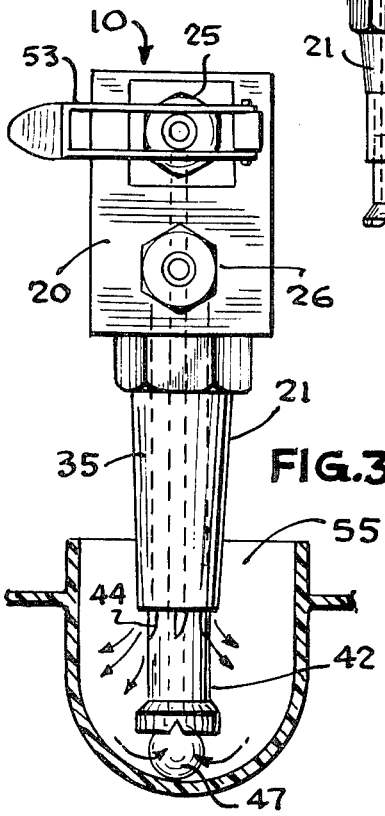
FIG. 3 is a partial end view of the combined aspirator and washer illustrating one of the nozzle members in operative communication with a well of a tray and a ball member retained in the orifice of the device.

As best seen in FIGS. 3 and 4, nozzle 21 has probe portion 42 extending from the end of inner tubular member 29 and contains a plurality of passages 43 in communication with fluid outlet channel 36. Passages 43 have deflecting wall surfaces 44 for effecting an outward direction to fluid passing outwardly from outlet channel 36.

Figure 5:
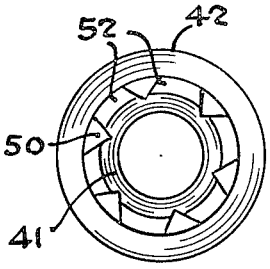
FIG. 5 is an end view taken along line 5—5 of FIG. 4.

As is best seen in FIG. 4, probe portion 42 has a concave or semicircular opening 45 having a somewhat smaller radius of curvature than a spherical ball member such as shown at 47. Referring specifically to FIG. 5, it will be seen that probe portion 42 at its orifice 41 has spaced projections 50 forming in effect passageways 52 therebetween.

It should also be pointed out that a shut-off valving device 53 is operatively carried by body section 20 for regulating the vacuum source in fluid outlet channel 23, the valving device being connected to connector 25.

OPERATION

A better understanding of the advantages of the combined washer and aspirator will be had by a description of its operation. As indicated earlier, washer-aspirator is preferably designed to be utilized in conjunction with a hepatitis detection method. Such a detection method will employ a plastic tray 54 having a multiplicity of well members 55 in which are placed small plastic beads or balls such as 47. These beads are precoated with guinea pig antibody. Patient serum is added into the wells to contact the beads 47. They are later subjected to an incubation period during which any antigen from this serum is fixed to the antibody. The antibody is later tagged with radioactive iodine-125 and it binds to the antigen on the bead creating an antibody-antigen-antibody "sandwich." In order to accomplish the foregoing "sandwich" it is preferable to utilize certain procedures. The plastic tray as well as a dispensing tube for the plastic beads or balls 47 is the subject matter of copending application entitled "Apparatus for Determining Immunoassays of Antigens and Their Antibodies," Ser. No. 487,350, which is commonly assigned and filed simultaneously herewith. The plastic beads 47 will be placed in the wells 55 and will have been contacted with serum. It will be necessary after the incubation period to remove the serum which is advantageously accomplished with the combined washer and aspirator 10. Vacuum line 13 will be interconnected to connector 25 and pumping device 11 will be interconnected to connection 26 by means of intake line 14. The vacuum source 15 will be activated and is preferably left on continuously with valve 53 being open. The probes 42 will be lowered into the wells 55 of the tray 54 until the orifice 41 surrounds the beads 47 and is partially accommodated in the semicircular opening 45. Pump 11 will then be activated to draw $5 \pm 1$ ml. of rinse solution from solution source 12 through intake lines 14 and 18 into fluid passage 24, through opening 46, passing through outlet channel 36 in tubular member 35. As the fluid will flow through outlet channel 36 it will ultimately engage passages 43 and deflecting wall members 44 causing the fluid to assume and outward pattern as shown by the arrows in FIG. 3. During the foregoing washing step a vacuum will have held spherical ball 47 in orifice 41. This vacuum is effected by a reduction in pressure in intake channel 30 which is in communication with vacuum passage 23 and ultimately with vacuum line 13. The fluid which is drawn through the described vacuum channel 30, passage 23 and line 13 will be deposited in vacuum trap bottles 16 and 17 by means of lines 13 and 48. It should be noted that when the vacuum source is applied, the spherical ball 47 will not be drawn completely into semicircular opening 45. This is effected by means of projections 50 extending from probe 42 with the spaces between the projections 50 forming passageways 52 for the inward flow of washing liquid. The foregoing procedure of dispensing fluid and aspirating by means of the vacuum source can be effected as many times as desirable, the purpose being to wash the excess serum from all portions of the beads as they are held in a stationary manner. They are later subjected to a counting device for the fixed radioactive iodine. In order to assure that the beads 47 are dry, the vacuum source 15 is left to continue to operate and to hold the beads against the orifice 41 which will cause a drying of the beads through the aspiration effect. In order to return the beads to the bottom of the tray wells 55 valve 53 is closed which will cause them to move away from the end of the probe 21.

It should be mentioned that in order to equalize the vacuum source over a plurality of beads, there should be provided a bead for every nozzle or probe member. This can be accomplished by using dummy beads where there is no serum to be deposited in a tray well.

It will be recognized that while a multiplicity of nozzles 21 and probes 42 are utilized in a single row with the nozzles positioned adjacent each other, these can be extended or arranged in double rows from a single header or body member in any geometric fashion and with any number of probes including only a single one. The combined aspirator and washer 10 can be advantageously utilized in any type of operation where a washing and aspirating of the washing fluid is to be accomplished. Further, it is not necessary that the washing take place prior to the aspirating but the aspirating effect could be utilized even prior to washing such as for the removal of fluid prior to the washing step. The body section 20 as well as the nozzle members 21 including the inlet ends or probes 42 are fabricated from stainless steel. However, other rigid or semirigid materials could be utilized such as ordinary steel, aluminum, or plastic materials depending upon the purpose to which the device is to be utilized. Pump 11 is of the type which will automatically force a controlled quantity of fluid in nozzles 21. The preferred pump is a vial filler sold by National Instrument Company of Baltimore, Maryland, under the trademark Filamatic. However, any type of automatic, sequentially regulated pump could be employed.

It will thus be seen that through the present invention there is now provided a combined aspirator and washer device which can effectively perform both a washing and drying method as well as a removal of the fluid from a cavity. The combined washer and aspirator device can be utilized in relatively small cavities and can effectively hold the member which is to be washed away from the container cavity. The combined washer and aspirator device is fabricated from a minimum number of parts and is sturdy in it construction. It utilizes a minimum number of moving parts and can be fabricated from many existing components.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

We claim:

1. A combined washer and aspirator device for a solid body member comprising a body section defining at least two independent fluid passages, a nozzle member operatively connected to said body section and defining a fluid intake channel and a fluid outlet channel in fluid communication with said fluid passages, said nozzle member having a probe portion defining an orifice having an internal wall surface, and positioning means operatively associated with said orifice to limit movement of said solid body member in a spaced manner from the wall surface of said orifice.

2. The combined washer and aspirator device as defined in Claim 1 wherein said fluid intake channel and said fluid outlet channel in said nozzle are formed from inner and outer concentrically positioned tubular members.

3. The combined washer and aspirator device as defined in claim 2 wherein said outer tubular member in conjunction with said inner tubular member defines a fluid outlet channel and terminates a short distance from said orifice.

4. The combined washer and aspirator device as defined in claim 3 wherein said inner tubular member is provided with deflecting wall surfaces spaces a short distance beyond the termination of said outer tubular member.

5. The combined washer and aspirator device as defined in claim 2 wherein a multiplicity of said nozzle members extend from said body section and said fluid intake channels and said fluid outlet channels are disposed in a concentric manner and communicate with said independent fluid passages in a substantially transverse manner.

6. The combined washer and aspirator device as defined in claim 5 wherein said nozzles are spaced in a linear manner and are adapted to fit within the confines of a substantially small well member of a tray.

7. The combined washer and aspirator device as defined in claim 6 wherein said body section is constructed and arranged to be manipulated by a human hand.

8. The combined washer and aspirator device as defined in claim 1 wherein said positioning means in said orifice comprises a concave indentation with projections extending from the wall of said orifice.

9. The combined washer and aspirator device as defined in claim 8 wherein said solid body member is spherical in configuration.

10. The combined washer and aspirator device as defined in claim 1 including a vacuum source operatively connected to one of said fluid passages in said body section, said one fluid passage operatively connected to said intake channel in said nozzle and further including means to regulate the vacuum source.

11. The combined washer and aspirator device as defined in claim 10 further including a regulated pump means operatively connected to the other of said fluid passages in said body section and to the fluid outlet channel in said nozzle.

* * * * *